US011674529B2

(12) United States Patent
Schneider et al.

(10) Patent No.: US 11,674,529 B2
(45) Date of Patent: Jun. 13, 2023

(54) PRESSURE COMPENSATION DEVICE DESIGNED FOR UNDERWATER APPLICATIONS

(71) Applicant: Robert Bosch GmbH, Stuttgart (DE)

(72) Inventors: Juergen Schneider, Wiesen (DE); Alexandre Orth, Waldbuettelbrunn (DE); Gofttfried Hendrix, Gemuenden (DE)

(73) Assignee: Robert Bosch GmbH, Stuttgart (DE)

( * ) Notice: Subject to any disclaimer, the term of this patent is extended or adjusted under 35 U.S.C. 154(b) by 224 days.

(21) Appl. No.: 16/604,822

(22) PCT Filed: Mar. 26, 2018

(86) PCT No.: PCT/EP2018/057579
§ 371 (c)(1),
(2) Date: Oct. 11, 2019

(87) PCT Pub. No.: WO2018/192749
PCT Pub. Date: Oct. 25, 2018

(65) Prior Publication Data

US 2020/0166056 A1 May 28, 2020

(30) Foreign Application Priority Data

Apr. 18, 2017 (DE) ..... 10 2017 206 498.6

(51) Int. Cl.
*F15B 1/04* (2006.01)
*F15B 1/10* (2006.01)
(Continued)

(52) U.S. Cl.
CPC ..... *F15B 1/04* (2013.01); *F15B 1/10* (2013.01); *F15B 1/165* (2013.01); *F15B 1/24* (2013.01);
(Continued)

(58) Field of Classification Search
CPC .... F15B 1/04; F15B 1/10; F15B 1/165; F15B 1/24; F15B 2201/32; F15B 2201/515
(Continued)

(56) References Cited

U.S. PATENT DOCUMENTS 2,085,777 A * 7/1937 Williams ..... F16J 15/40 277/365
2,418,194 A * 4/1947 Piccardo ..... F04D 29/128 277/366
(Continued)

FOREIGN PATENT DOCUMENTS

DE 32 46 338 A1 6/1984
DE 10 2011 009 276 A1 7/2012
GB 2 373 546 A 9/2002

OTHER PUBLICATIONS

International Search Report corresponding to PCT Application No. PCT/EP2018/057579, dated Jun. 6, 2018 (German and English language document) (5 pages).

*Primary Examiner* — Robert K Arundale
*Assistant Examiner* — Richard K. Durden
(74) *Attorney, Agent, or Firm* — Maginot, Moore & Beck LLP

(57) ABSTRACT

A system filled with a fluid, designed for underwater applications, in which the interior of a housing and/or tank forms a fluid region which is sealed with respect to the surrounding seawater region, includes at least one hydraulic pressure compensation device, which at least raises the pressure level of the fluid region to the ambient pressure prevailing in the seawater region. The pressure compensation device is constructed in two stages in such a way that at least one store having a flexible wall region and at least one piston store having a displaceable piston are arranged in series. The use of the pressure compensation device to pressurize at least one housing filled with fluid for a hydraulic actuating shaft is also proposed.

10 Claims, 4 Drawing Sheets

(51) Int. Cl.
*F15B 1/24* (2006.01)
*F15B 1/16* (2006.01)

(52) U.S. Cl.
CPC ..... *F15B 2201/21* (2013.01); *F15B 2201/31* (2013.01); *F15B 2201/312* (2013.01); *F15B 2201/3151* (2013.01); *F15B 2201/3152* (2013.01); *F15B 2201/32* (2013.01); *F15B 2201/405* (2013.01); *F15B 2201/515* (2013.01)

(58) Field of Classification Search
USPC ..... 138/30, 31; 277/926
See application file for complete search history.

(56) References Cited

U.S. PATENT DOCUMENTS 2,958,795 A * 11/1960 Luenberger ..... H02K 5/132 310/87
3,230,975 A * 1/1966 Mercier ..... F15B 1/10 138/30
3,555,834 A * 1/1971 Weston, Jr. ..... H05K 5/068 405/185
3,581,774 A 6/1971 Oeland, Jr. et al.
3,777,573 A * 12/1973 Alinari ..... G01L 7/06 73/865.1
4,185,652 A * 1/1980 Zintz ..... E21B 33/0355 137/628
5,772,216 A * 6/1998 Bredemeyer ..... F16J 15/406 277/318
2003/0075225 A1* 4/2003 Dinkel ..... F15B 1/24 138/31
2005/0224224 A1* 10/2005 Martin ..... E21B 19/22 166/77.3
2006/0075892 A1* 4/2006 Dorr ..... F15B 15/2807 92/5 R
2010/0202896 A1* 8/2010 Du ..... F04D 13/10 417/53
2014/0147299 A1* 5/2014 Tomter ..... F04C 15/0092 417/228
2016/0025085 A1* 1/2016 Hay ..... F04D 25/0686 417/53
2017/0255210 A1* 9/2017 Wu ..... F15B 1/265

* cited by examiner

PRESSURE COMPENSATION DEVICE DESIGNED FOR UNDERWATER APPLICATIONS

This application is a 35 U.S.C. § 371 National Stage Application of PCT/EP2018/057579, filed on Mar. 26, 2018, which claims the benefit of priority to Ser. No. DE 10 2017 206 498.6, filed on Apr. 18, 2017 in Germany, the disclosures of which are incorporated herein by reference in their entirety.

The present invention disclosure relates to a pressure compensation device for a hydraulic system designed for underwater applications.

BACKGROUND

The use of hydraulic and/or electric and/or mechanical components underwater, in particular at large depths, is problematic because the components can be damaged by water, in particular seawater. In particular the high ambient pressure of the water makes pressure compensation necessary. For this purpose, use can be made of hydraulic pressure compensators which can raise the pressure level of a hydraulic system used in the underwater region to the ambient pressure prevailing in the water. For this purpose, use can be made of diaphragms which are loaded on one side with seawater of the surroundings and on the other side are connected to a reservoir of the hydraulic system. A disadvantage with this arrangement is that, in the event of damage to the diaphragm, which forms a boundary surface, seawater can penetrate into the hydraulic system. It additionally has to be taken into consideration that the diaphragm can be loaded with a compression spring whose spring force can diminish and hence the maintenance-free operating time can be limited.

SUMMARY

Against this background, it is an object of the present disclosure to provide a device and to specify a use which alleviate or even avoid the stated disadvantages. In particular, it is intended to reliably avoid penetration of seawater into the hydraulic system in a structurally simple manner. Furthermore, it is intended to significantly increase the operating period of the pressure compensation device.

These objects are achieved by a device and a use as described herein It should be pointed out that the description, in particular in conjunction with the figures, sets out further details and developments of the disclosure which can be combined with the other features disclosed herein.

A contribution is made in this respect by a pressure compensation device which is designed for underwater applications. It serves to seal an interior of a housing, which itself forms an (inner) fluid region, with respect to the surrounding seawater region, wherein a pressure level of the fluid region can be raised at least to the ambient pressure prevailing in the seawater region by means of the pressure compensation device. The hydraulic system which is designed for underwater applications can therefore comprise an interior of a housing (for example of a hydraulic and/or electric component, such as an electric motor, a pump, a tank or the like) which forms a fluid region which is sealed with respect to the surrounding seawater region. For this purpose, there is provided the at least one hydraulic pressure compensation device which can raise the pressure level of the fluid (hydraulic liquid, transformer oil, lubricant, etc.) in the fluid region at least to the ambient pressure prevailing in the (surrounding) seawater region.

The pressure compensation device is constructed in two stages in such a way that at least one accumulator with a flexible wall region and at least one piston accumulator with a displaceable piston are arranged in series.

The device proposed here in a fluid-filled system (or hydraulic installation or electrical system with transformer oil or mechanical system with lubricant) which is arranged underwater has the specific advantage that underwater pressure compensation is realized with a two-fold (redundant) barrier against penetration of seawater. The two barriers are arranged and connected in series. That means in other words in particular that at first the at least one accumulator with the flexible wall region can be loaded with the seawater, with the result that the flexible wall is movable in reaction to the seawater pressure. The movement of the flexible wall can then be transmitted (while being separated from the direct influence of the seawater) to a movement of the piston in the downstream piston accumulator. Use can be made for this purpose of a transmission medium, in particular a liquid. The (resulting) movement of the piston can lead (directly) to a pressure adaptation in the fluid region, for which purpose the piston is preferably in direct contact with the fluid region. Two separate component failures (in the accumulator and the piston accumulator) would therefore have to occur in this arrangement before seawater can penetrate into the inner region of the system. The device is therefore distinguished by a high level of reliability, with the result that the system is designed, for example, for an operating time of 20 years and more and requires a minimum of maintenance, preferably none.

The inner fluid (for example a hydraulic medium, transformer oil or lubricant) is isolated and can thus have a pressure which is substantially equal to or even higher than the surroundings (for example seawater). The two barriers (flexible wall and piston) result in the seawater having to pass through two sealing points (diaphragm and piston seal) before it could penetrate into the system (redundancy to prevent system errors). A further contribution to the reliability is provided by the fact that no compression spring directly acts on or loads the flexible wall (for example in the manner of a diaphragm), with the result that the service life of the system is considerably increased.

The accumulator (in operative connection with the seawater) with a flexible wall region can be a diaphragm accumulator or a bladder accumulator. In the case of a diaphragm accumulator there can be provided a diaphragm which is substantially plate-shaped and whose periphery is (fixedly) connected to an accumulator wall and which is movable radially inward in reaction to a pressure prevailing there. A bladder accumulator can be configured with a flexible wall which encloses a predeterminable bladder accumulator volume and can move axially and radially in reaction to a pressure prevailing there. The flexible wall and/or the membrane are/is in particular fluid-tight and resistant to contact with seawater under high pressure.

The piston of the piston accumulator is expediently loaded by at least one compression spring. The compression spring can serve to set a predeterminable prestress, for example in order to set a pressure level which is increased with respect to the pressure generated by the seawater on the fluid region. The piston is configured in particular with a rigid piston plate on which the compression spring acts. Damage to or overloading of this rigid piston as a result of the compression spring loading can thus be permanently avoided.

The fluid in the fluid region is preferably prestressed at 0.5 to 10 bar with respect to the pressure of the surrounding seawater region. For this purpose, a correspondingly designed compression spring can be provided in the piston accumulator, by means of which spring the prestress lying above the seawater pressure level can be set.

The piston of the piston accumulator is advantageously assigned a displacement transducer. The displacement transducer is particularly designed to detect the current stroke or the current position of the piston with respect to a reference position or the piston accumulator. A displacement transducer in this sense is particularly a sensor by means of which a position of the piston can be directly/indirectly determined or measured. The sensor can comprise an end-position switch or a pressure switch. This allows a possible leakage to be monitored by monitoring the position of the piston, for example if a movement of the piston is determined under unchanged pressure conditions.

The piston of the piston accumulator can comprise a plurality of downstream (in the direction of action of the pressure) sealing devices. The piston can preferably seal an opening of a second interior of the piston accumulator with respect to the fluid region. The piston can additionally have, with respect to a cylinder tube (piston cylinder housing), at least one seal which is swellable (in contact with seawater).

An interspace, which is filled with a transmission medium (fluid and/or gas), is preferably formed by the at least one accumulator with a flexible wall region and by the at least one piston accumulator. An (outlet-side) second interior of a diaphragm accumulator or bladder accumulator and an (inlet-side) first interior of a piston accumulator advantageously form an interspace which is filled (partially or completely) with a fluid and/or gas. The fluid (or transmission fluid) in the (outlet-side) second interior of the accumulator with a flexible wall region and the (inlet-side) first interior of the piston accumulator is preferably a hydraulic fluid, a mechanical grease-like medium or a dielectric transformer oil.

The fluid in the (outlet-side) second interior of the piston accumulator and in the fluid region is advantageously an oil, in particular a transformer oil.

With further preference, the pressure compensation device is designed in the manner of a hollow cylinder in such a way that an inner bladder accumulator is surrounded by an outer piston accumulator. This allows a particularly compact design. Corresponding to the ambient pressure under water, seawater can thus (axially and/or radially) expand/contract the bladder accumulator inside the piston accumulator. The resulting change in volume of the bladder accumulator for example moves an external (preferably substantially incompressible) transmission medium, which in turn results in an inward/outward movement (displacement) of the piston. For this purpose, a piston plate can interact with the bladder accumulator loosely or only via the transmission medium.

An expedient arrangement is one in which a plurality of pressure compensation elements are arranged in bores in the drum jacket of a type of drum through whose central opening an actuating shaft of an electronic or hydraulic component can be guided. For this purpose, the drum can have a plurality of bores which are arranged in a distributed manner over a drum periphery and a central through-passage opening. The bores are suitable for receiving pressure compensation elements. Here, the pressure compensation elements can be connected to one another in parallel and/or in series in order to increase the redundancy in the event of a failure and/or in order to (jointly) adapt the stroke compensation. The central through-passage opening can be arranged (with a sealing action) around an actuating shaft of an electronic or hydraulic component (electric motor, pump, cylinder compensator, etc.).

According to another aspect, the use of a here proposed pressure compensation device (or above arrangement with a drum) for pressurizing at least one housing filled with fluid (for example with hydraulic liquid, oil, grease, lubricant, etc.) for a hydraulic actuating shaft of an electric motor, of a pump and/or of a cylinder compensator is proposed. The at least one pressure compensation device is used in particular to apply ambient pressure (water pressure) to an integrated hydraulic actuating shaft (electric motor, pump, cylinder compensator) in its oil-filled housing. The (plurality of) pressure compensators are preferably accommodated in a type of drum for this purpose. The cylinder or a rod of the cylinder can be guided through the central opening of the drum, thus allowing a space-saving integrated design.

The here proposed measures are particularly based on the concept of designing a two-stage pressure compensator with a bladder accumulator or diaphragm accumulator which forms the seawater/intermediate pressure space boundary surface and with a piston accumulator or spring piston accumulator which produces contact with the hydraulic reservoir. Two boundary surfaces are now present instead of one; this increases the sealing tightness and the operational stability. In addition, a prestress lying above the seawater pressure level can be set in the piston accumulator or spring piston accumulator by means of a spring.

BRIEF DESCRIPTION OF THE DRAWINGS

The disclosure and the technical field are explained in more detail below with reference to figures. Here, identical components are designated by identical reference signs. The illustrations are schematic and not intended to illustrate size relationships. The explanations set out with respect to individual details of a figure can be extracted and freely combined with technical matters from other figures or the present description, unless something else necessarily results for a person skilled in the art or such a combination is explicitly forbidden here. In the drawings.

DETAILED DESCRIPTION

Figure 1:
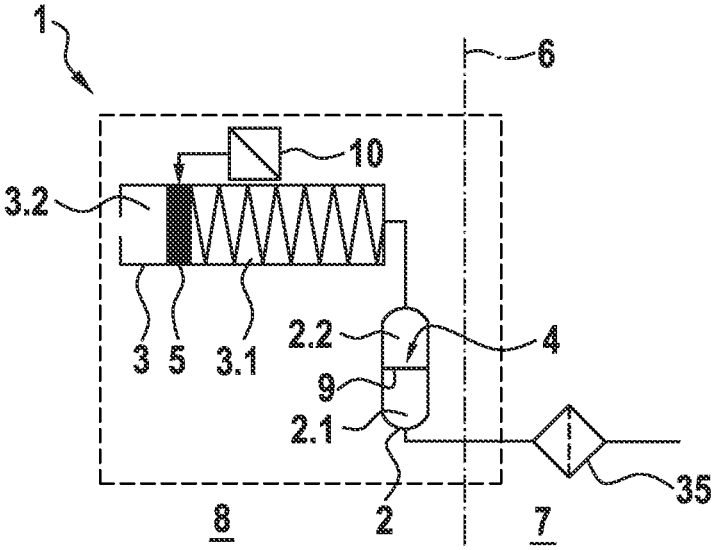
FIG. 1 shows a circuit diagram of a pressure compensation device having—arranged in series—a diaphragm accumulator and a piston accumulator.

FIG. 1 shows the basic illustration of a circuit diagram of a pressure compensation device 1 having—arranged and connected in series—an accumulator 2 with a flexible wall region 4 and a piston accumulator 3 with a displaceable piston 5. The accumulator 2 with flexible wall region 4 is explained in FIGS. 1, 2 and 3 using the example of a diaphragm accumulator and in FIGS. 4 and 5 using the example of a bladder accumulator. Furthermore, the flexible wall 4 is explained in FIGS. 1, 2 and 3 using the example of a nonpenetrable diaphragm 9 and in FIGS. 4 and 5 using the example of a nonpenetrable bladder 23.

Figure 4:
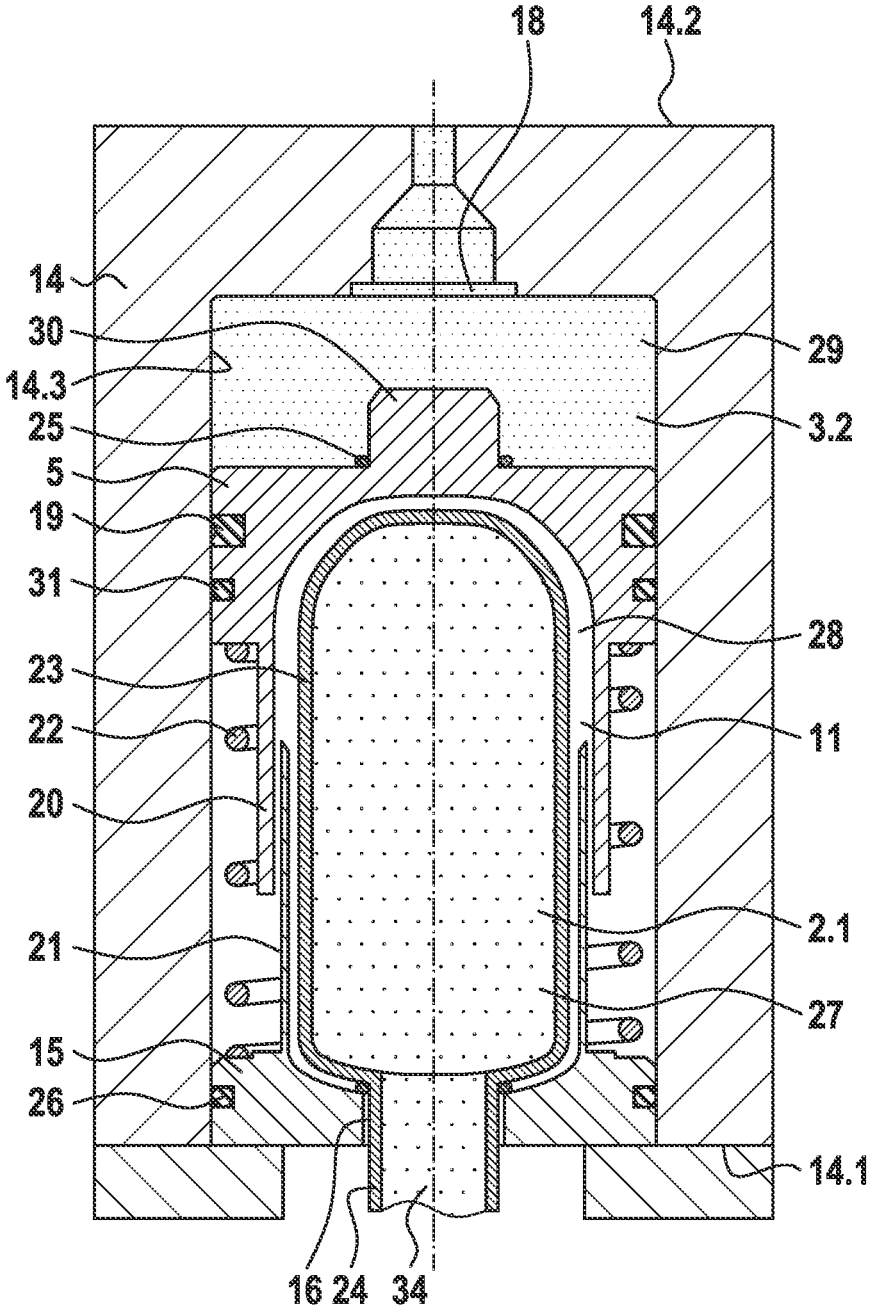
FIG. 4 shows a structural embodiment of a pressure compensation device.

The diaphragm accumulator 2 has an (inlet-side) first interior 2.1 and an (outlet-side) second interior 2.2 which are separated from one another and sealed with respect to one another by a flexible wall region 4, for example an elastic metal diaphragm (or, according to FIG. 4, a rubber bladder). The piston accumulator 3 has an (inlet-side) first interior 3.1 and an (outlet-side) second interior 3.2 which are separated from one another by the displaceable piston 5 and sealed with respect to one another by means of seals. Reference sign 6 designates in dot-dash line a schematic separating line, on the right-hand side of which the seawater region 7 is situated and on the left-hand side of which the (inner) fluid region 8 is situated. A filter 35 for the seawater is arranged upstream of the diaphragm accumulator. The seawater filter can serve to avoid a situation in which dirt particles clog the bore to the diaphragm. Furthermore, the displaceable piston 5 of the piston accumulator 3 is assigned a displacement transducer 10.

Figure 2:
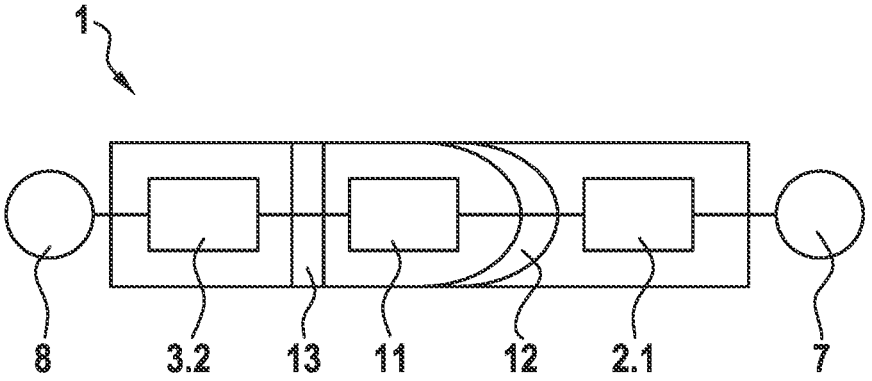
FIG. 2 shows a block diagram of a pressure compensation device between seawater region and (inner) fluid region.

FIG. 2 illustrates a block diagram of the pressure compensation device 1, for example also according to FIG. 1, between the seawater region 7 and the fluid region 8. The first interior 2.1 of the diaphragm accumulator 2 is connected to the seawater region 7, and the second interior 3.2 of the piston accumulator 3 is connected to the fluid region 8. The second interior 2.2 of the diaphragm accumulator 2 and the first interior 3.1 of the piston accumulator 3 functionally form a common interspace 11. The interspace 11 can be structurally designed as a single space. The interspace 11 can also consist of two individual spaces, that is to say of the second interior 2.2 and the first interior 3.1, which are interconnected by a pipeline or the like. A first boundary, formed by for example a diaphragm 9, is designated by 12, and a second boundary, formed by for example a piston 5, is designated by 13. The two boundaries 12, 13 form a two-fold safeguard (redundancy) against penetration of seawater into the fluid region 8.

The first interior 2.1 of the diaphragm accumulator 2 is filled with seawater (first medium 27) which loads the one side of the diaphragm 9 with the ambient pressure prevailing in the water. The water pressure in the seawater region 7 and in the first interior 2.1 is equal. The interspace 11 contains a second medium 28 (transmission medium), for example a hydraulic fluid, a grease-like substance, a dielectric transformer oil or a gas, in particular nitrogen. The second medium 28 is pressurized by the other side of the diaphragm 9, with the result that the interspace 11 forms an intermediate pressure space. Furthermore, the pressure of the medium loads the one side of the piston 5 of the piston accumulator 3. The second interior 3.2 of the piston accumulator 3 is filled with a third medium 29, preferably with transformer oil. Here, the other side of the piston 5 exerts pressure on the medium 29. This pressure simultaneously acts on the medium 29 which fills the (not shown) downstream devices, for example tank or housing. Consequently, the pressure in the inner fluid region 8 and in the second interior 3.2 of the piston accumulator 3 is equal.

The system device arranged downstream of the pressure compensation device 1 can take the form of a container-like module, wherein a plurality of such modules can be deposited on the seabed. The container is filled with a dielectric liquid, for example a hydraulic oil, with the result that all the components in the module are immersed in the liquid. The pressure compensation device 1 achieves pressure compensation between the inside of the container and the external surroundings (seawater region 7) in such a way that the liquid in the container is placed under the same pressure as prevails in the external surroundings. For this purpose, the pressure compensation device 1 has two separating surfaces or boundary surfaces: a flexible separating element (diaphragm 9 or bladder 23) which is in contact on its one side with the seawater, and a piston 5 which is subjected on its other side to the action of the liquid which is situated in the container. The interspace 11 is arranged between the two separating elements. The pressure compensation device 1 presented here has the particular advantage that seawater which has penetrated unintentionally through the diaphragm 9 does not pass (directly) into the container but, hampered by the piston 5, remains in the interspace 11 and can be removed there. There is thus present a double safeguard against penetrated seawater. An additional further safeguard consists in the fact that the piston 5 of the piston accumulator 3 is acted upon by a compression spring 22 (see also FIG. 4), with the result that the medium 29 is under a prestress. The prestress pressure is slightly greater than the ambient pressure, for example 0.5 to 10 bar, thereby preventing seawater from penetrating into the downstream device. To detect a leakage in the piston accumulator 3, the piston 5 is assigned the displacement transducer 10 which monitors the position of the piston 5.

Figure 3:
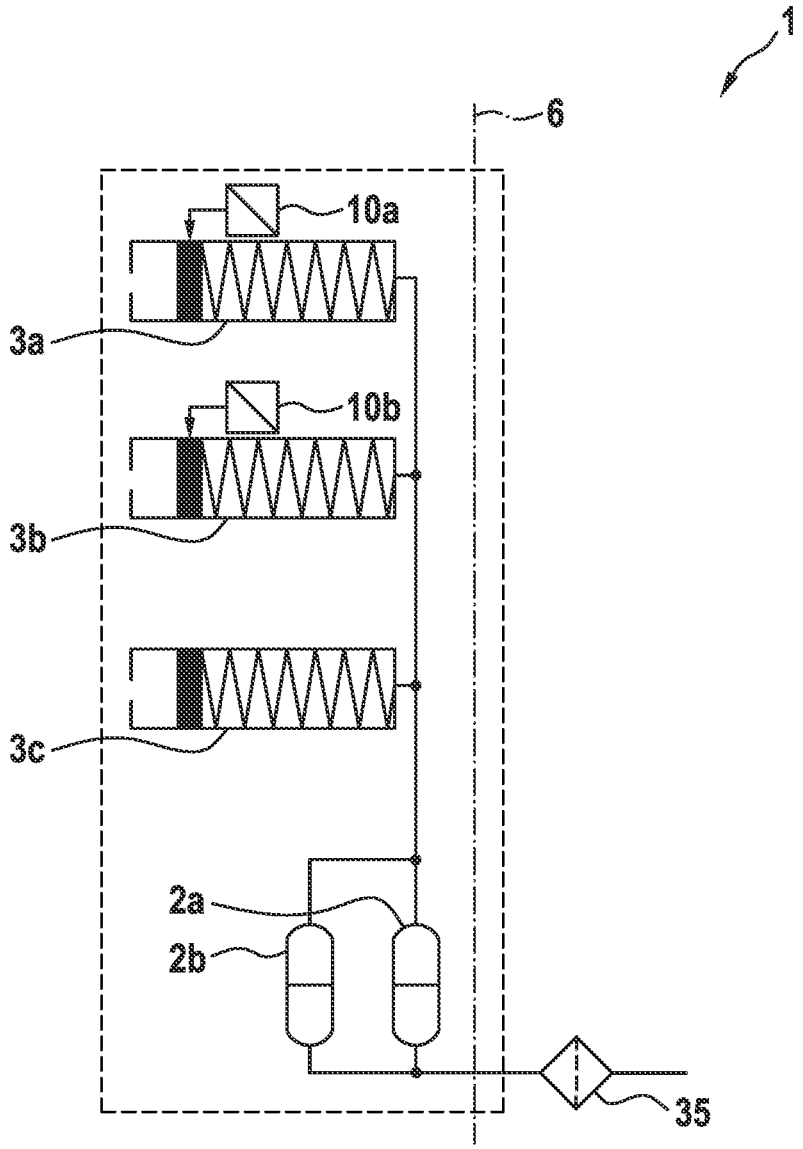
FIG. 3 shows a circuit diagram of a pressure compensation device having two diaphragm accumulators and three piston accumulators which are in each case arranged parallel to one another.

FIG. 3 shows a circuit diagram of a pressure compensation device, such as, for example, also according to FIG. 1, but with two diaphragm accumulators 2*a*, 2*b* and three piston accumulators 3*a*, 3*b*, 3*c* which are in each case arranged and connected parallel to one another. There is in this way realized a greater volume of the interiors of the diaphragm accumulators 2*a*, 2*b* and of the piston accumulators 3*a*, 3*b*, 3*c*.

FIG. 4 illustrates a structural embodiment of a pressure compensation device 1, in particular also according to the circuit diagram illustrated in FIG. 1. The embodiment is distinguished by the fact that the accumulator 2 with the flexible wall region 4 and the piston accumulator 3 are formed in the manner of a compact cylinder, with the result that a particularly space-saving design is realized. The pressure compensation device 1 is designed in the manner of a hollow cylinder in such a way that an inner bladder accumulator 2 is surrounded by an outer piston accumulator 3. As FIG. 4 illustrates, the piston accumulator 3 consists of a cylinder tube 14 and a piston 5 as separating element. A closure cover 15, which has a central through-opening 16, is present on a first end side 14.1 of the cylinder tube 14. A central through-opening 18, which opens with the inner fluid region, is present on the other second end side 14.2 of the cylinder tube 14. The piston 5 is sealed with respect to the inner lateral surface 14.3 of the cylinder tube 14 by means of seals 19. A first hollow cylinder 20 grows out of the surface of the piston 5 that faces the opening 16, and a further hollow cylinder 21 grows out of the surface of the closure cover 15 that faces the opening 18, the open ends of which cylinder overlap one another. Between the outer first hollow cylinder 21 and the inner lateral surface 14.3 there is arranged a compression spring 22 which is supported by the one end on the closure cover 15 and by the other end on the piston 5. In the inner cavity formed by the hollow cylinders 20 and 21 there is situated a bladder 23, for example consisting of an elastomer, of a bladder accumulator 2, which bladder serves as a separating wall. The bladder 23 has two (axially) opposite end regions, with—in each case at a distance—the end regions being situated opposite to the piston 5 or to the closure cover 15 and the central region being situated opposite to the hollow cylinders 20, 21 in such a way that an interspace 11 is formed. The lower end region of the bladder 23 transitions into a hollow cylinder-like through-connection 24 with an opening 34 for the passage of seawater (first medium 27), said connection engaging through the opening 16.

The mode of operation is such that a pressure-loaded first medium 27 (seawater) fills the bladder 23, which widens under the pressure and thus in turn displaces a second medium 28 outside the bladder 23. This medium 28 in turn is braced between the bladder 23 and the piston 5 and drives the latter in the axial direction (cylinder function) by the widening of the bladder 23 and the medium 28. The piston 5 is additionally sealed with respect to the cylinder tube 14 by means of a piston seal (redundant). The piston 5 is preloaded by a compression spring 22 and thus ensures prestressing of the system with respect to the pressure of the first medium 27. Consequently, a medium on the piston side, which can be a third medium 29 or else the same medium as the second medium 28, is loaded (on the outlet side) separately from and with a prestress with respect to the first medium 27.

There can optionally be provided safeguarding of the pressure compensation against possible escape of first medium 27 caused by damage to the bladder 23 upon complete unloading of the prestress (piston 5 in the end position) and upon pressure equalization, for example leakage of the piston seal 19. The piston 5 of the pressure compensation is moved by the spring 22 into the end position and thus closes the opening 18 at the outlet by means of an (annular) seal 25 on the piston 5. Here, a cylindrical projection 30 on the piston 5 preferably engages in the opening 18 in a form-fitting manner.

Furthermore, safeguarding can optionally be present by means of an additional sealing ring 31 on the piston 5 that, for example, swells by contact with a medium other than the operating fluid or transmission fluid. The swelling of the sealing ring 31 results in a form fit which produces sealing tightness between the piston 5 and the cylinder tube 14.

The pressure compensation serves for equalizing two pressures in a system which operate with media which are used separately from one another, such as oil and water, for example. This pressure compensation makes it possible by means of the spring 22 to prestress one side with higher pressure so as to prevent the other medium with lower pressure penetrating into the system. Moreover, the separation is redundant since two different methods of separation of liquid or gaseous media are arranged in series here without requiring a relatively large space requirement.

Figure 5:
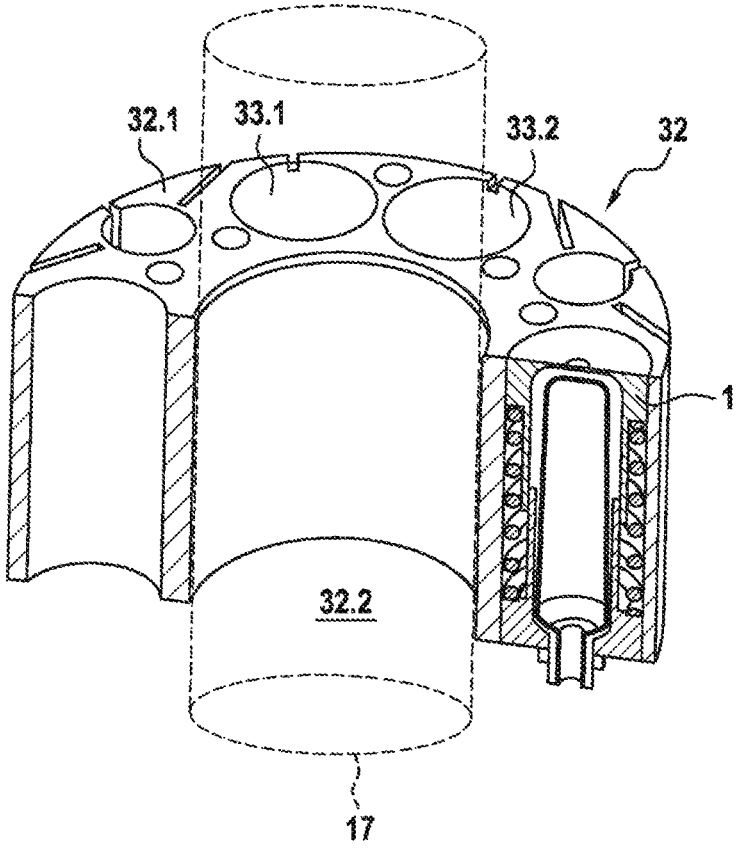
FIG. 5 shows an arrangement of a plurality of pressure compensation devices in a common drum-like holding element.

FIG. 5 shows an arrangement for a plurality of pressure compensation devices 1 (for example according to FIG. 4) in a common holding element. The pressure compensation devices 1 are arranged parallel to one another in the longitudinal direction. In this way, a relatively large volume for the pressure compensation (redundancy) is realized. A hollow cylinder 32 in the manner of a drum-half-cut-open in FIG. 5—has a cylinder jacket 32.1 (hollow cylinder wall) and a cylinder interior 32.2. The cylinder jacket 32.1 is penetrated by a plurality of through-bores 33.1, 33.2 which are oriented parallel to the center axis in the longitudinal direction and into each of which a pressure compensation device 1 is plugged in a form-fitting manner. FIG. 5 illustrates—in a half-cut-open view—only one pressure compensation device 1 arranged in a bore 33. The hollow cylinder 32 is formed as a drum in a similar manner to a revolver magazine.

The pressure compensation device 1 according to FIG. 5 can be used to apply ambient pressure (water pressure) to an integrated hydraulic actuating shaft 17 (electric motor, pump, cylinder compensator) in its oil-filled housing. For this purpose, the (plurality of) pressure compensators 1 are accommodated in a type of drum. The cylinder or a rod of the cylinder can be guided through the central opening or the cylinder interior 32.2 of the drum, thus allowing a space-saving integrated design.

LIST OF REFERENCE SIGNS

1 Pressure compensation device
2, 2*a*, 2*b* Accumulator with flexible wall region
2.1 First interior
2.2 Second interior
3, 3*a* to 3*c* Piston accumulator
3.1 First interior
3.2 Second interior
4 Flexible wall region
5 Piston
6 Separating line
7 Seawater region
8 Fluid region
9 Diaphragm
10, 10*a*, 10*b* Displacement transducer
11 Interspace
12 First boundary
13 Second boundary
14 Cylinder tube
14.1 First end side
14.2 Second end side
14.3 Inner lateral surface
15 Closure cover
16 Opening
17 Actuating shaft
18 Opening
19 Seal
20 First hollow cylinder
21 Second hollow cylinder
22 Compression spring
23 Bladder
24 Connection
25 Seal
26 Seal
27 First medium
28 Second medium
29 Third medium
30 Projection
31 Sealing ring
32 Hollow cylinder
32.1 Cylinder jacket
32.2 Cylinder interior
33.1, 33.2 Bores
34 Opening
35 Filter

The invention claimed is:

1. A pressure compensation device designed for underwater applications and configured to seal a housing with respect to a surrounding seawater region, said housing forming a fluid region, the pressure compensation device comprising:

at least one accumulator with a flexible wall region, the at least one accumulator defining a first interior space fluidly connected to the seawater region and a second interior space separated from the first interior space by the flexible wall region; and at least one piston accumulator with a displaceable piston, the at least one piston accumulator having a third interior space fluidly connected to the second interior space and a fourth interior space fluidly connected to the fluid region, the piston sealing the third interior space from the fourth interior space, wherein the pressure compensation device is configured to raise a pressure level of the fluid region to between 0.5 and 10 bar greater than the ambient pressure prevailing in the seawater region, and wherein the pressure compensation device is constructed in two stages in such a way that the at least one accumulator and the at least one piston accumulator are arranged in series.

2. The pressure compensation device as claimed in claim 1, wherein the at least one accumulator with the flexible wall region includes one of a diaphragm accumulator and a bladder accumulator.

3. The pressure compensation device as claimed in claim 1, further comprising:

at least one compression spring configured to load the piston of the piston accumulator.

4. The pressure compensation device as claimed in claim 3, wherein the at least one spring loads the piston in a direction towards increasing the pressure level of the fluid region so as to increase the pressure level to between 0.5 and 10 bar greater than the ambient pressure.

5. The pressure compensation device as claimed in claim 1, further comprising:

a displacement transducer configured to monitor a position of the piston of the piston accumulator.

6. The pressure compensation device as claimed in claim 1, wherein the piston of the piston accumulator comprises a plurality of downstream sealing devices.

7. The pressure compensation device as claimed in claim 1, wherein the second interior space and the third interior space form an interspace that is defined by the at least one accumulator with the flexible wall region and by the at least one piston accumulator, the interspace being filled with a transmission medium.

8. The pressure compensation device as claimed in claim 1, wherein the pressure compensation device is configured as a hollow cylinder in which the at least one accumulator includes an inner accumulator that has a flexible bladder forming the flexible wall region and the at least one piston accumulator includes an outer accumulator that surrounds the inner accumulator.

9. An arrangement comprising:

a hollow cylinder configured as a drum and defining a central opening configured to guide an actuating shaft of an electronic or hydraulic component, the hollow cylinder defining a plurality of bores; and a plurality of pressure compensation devices configured to seal a housing with respect to a surrounding seawater region, said housing forming a fluid region, each pressure compensation device arranged in an associated one of the plurality of bores, each pressure compensation device comprising:

at least one accumulator with a flexible wall region; and at least one piston accumulator with a displaceable piston, wherein the plurality of pressure compensation devices are configured to raise a pressure level of the fluid region at least to the ambient pressure prevailing in the seawater region, and wherein each pressure compensation device is constructed in two stages in such a way that the at least one accumulator and the at least one piston accumulator are arranged in series.

10. A method of using a pressure compensation device comprising:

pressurizing at least one fluid-filled housing for a hydraulic actuating shaft of one of an electric motor, a pump, and a cylinder compensator with the pressure compensation device to a pressure level that is between 0.5 and 10 bar greater than the ambient pressure prevailing in a surrounding seawater region, the pressure compensation device including:

at least one accumulator with a flexible wall region, the at least one accumulator defining a first interior space fluidly connected to the seawater region and a second interior space separated from the first interior space by the flexible wall region; and at least one piston accumulator with a displaceable piston, the at least one piston accumulator having a third interior space fluidly connected to the second interior space and a fourth interior space fluidly connected to the fluid region, the displaceable piston sealing the third interior space from the fourth interior space, wherein the pressure compensation device is constructed in two stages in such a way that the at least one accumulator and the at least one piston accumulator are arranged in series.

* * * * *